US006691637B1

(12) United States Patent
Smith et al.

(10) Patent No.: US 6,691,637 B1
(45) Date of Patent: Feb. 17, 2004

(54) CUSTOM FIT T-TOP FOR A MARINE VESSEL

(75) Inventors: Carl E. Smith, Greensboro, NC (US); Charles Wegman, Greensboro, NC (US)

(73) Assignee: C. E. Smith Co., Inc., Greensboro, NC (US)

( * ) Notice: Subject to any disclaimer, the term of this patent is extended or adjusted under 35 U.S.C. 154(b) by 0 days.

(21) Appl. No.: 10/150,750

(22) Filed: May 17, 2002

(51) Int. Cl.[7] ..... B63B 17/00
(52) U.S. Cl. ..... 114/361
(58) Field of Search ..... 114/343, 361; 135/87, 88.01, 88.13, 121

(56) References Cited

U.S. PATENT DOCUMENTS 4,593,641 A * 6/1986 Adams et al. ..... 114/343
5,918,613 A * 7/1999 Larson ..... 135/88.01
6,349,666 B1 * 2/2002 Hastings ..... 114/361

OTHER PUBLICATIONS

Boston Whaler, catalog 1993, p. 38, Rockland, MA.*
Digital picture of a boat top entitled Dealer display, columbia SC, 2001.
Photo of a boat top from the internet; 2001.
Digital pictures of a boat top from the Charleston SC Shallow Water Boat Show, Apr. 2001.
Digital photos of boat tops from the Miami Boat Show; 2001.
Boater's World catalog, p. 88; 2001.
Overton's catalog, p. 52; 2001.
Digital photo of a boat top from the Raleigh Boat Show; 2001.
Birdsall Marine; photo of a boat top from their website; undated.
Brochure of boat tops from Atlantic Towers; undated.

* cited by examiner

*Primary Examiner*—Stephen Avila
(74) *Attorney, Agent, or Firm*—MacCord Mason PLLC

(57) ABSTRACT

A vehicle having a canopy including a vehicle, a console, and an integrally adjustable frame attached to the console, the frame including a first stand, a second stand, a plurality of lateral support frames, at least one pair of transverse support frames, each of the frames having a connector connecting along the length of each of the lateral support frames, a front brace for attaching to the first and second stands, and a canopy assembly attached to the laterally adjustable frame.

69 Claims, 5 Drawing Sheets

CUSTOM FIT T-TOP FOR A MARINE VESSEL

BACKGROUND OF THE INVENTION (1) Field of the Invention

The present invention relates generally to marine vessels and, more particularly, to a marine vessel having a console to which a canopy may be attached for providing shelter from sun and rain.

(2) Description of the Prior Art

Sport fishing boats are often outfitted with permanent canopies generally referred to as T-tops. A T-top provides shelter from sun and rain, as well as a place to mount enclosures, antennas, rod holders and outriggers. Aluminum tubing is by far the most commonly used material. Stainless steel is sometimes used for these structures, but it is both heavier and significantly more expensive than aluminum.

T-tops come in three forms: first, OEM (original equipment manufacturer) units that are part of a standard feature package or that are ordered as accessories on a new boat and installed by the boat manufacturer; second, retail off-the-shelf, after-market units made by accessory manufacturers and sold directly to boat owners; and third, custom units built by skilled metal fabricators to fit a specific boat and to incorporate features requested by the customer.

OEM units generally have good fit and high quality, make efficient use of space and are the least hassle for the buyer. T-tops made for OEM are installed at the factory and consequently make shipment of the boat to the dealer more costly as they greatly reduce the number of boats that can be stacked on a trailer. OEM T-tops are typically 100% welded aluminum construction.

After-market T-tops are an economical way to add shade to a boat already owned. However, the quality, fit and visual appeal of these T-tops may be poor.

Custom T-top features and functionality are limited only by imagination and cost. Close cooperation between the owner and the builder is an advantage of having a custom unit built. One drawback to custom fabrication is that custom aluminum or stainless steel fabrication is expensive and time-consuming. Another drawback is that construction is generally 100% welded which requires skilled fabricators and is prone to cracking and to fatigue damage. The higher cost can be lowered however, if the builder has previously done a similar installation, since the builder will not be starting from scratch.

Thus, there remains a need for a new and improved canopy for a marine vessel having a console that includes a laterally adjustable frame which permits the canopy to be attached to many different width consoles while, at the same time, provides comparable appearance and strength to custom built canopies.

SUMMARY OF THE INVENTION

The present invention is directed to a vehicle having a canopy. The apparatus includes a vehicle; a console; and a laterally adjustable frame attached to the console. A canopy assembly attaches to the laterally adjustable frame for providing shelter from sun and rain.

In the preferred embodiment, the laterally adjustable frame includes: a first stand; a second stand; a plurality of lateral support frames; at least one pair of transverse support frames, each of the transverse support frames having a connector connecting along the length of each of the lateral support frames; and a front brace for attaching to the first and second stands.

Also, in the preferred embodiment, the first and second stands may be inclined up to about 10 degrees towards the centerline for providing some additional strength or for following the lines of the console with 3 degrees being preferred.

The lateral support frames may be offset from one another, laterally continuous, C-frames or, in the preferred embodiment, a ladder frame. The transverse support frames are substantially parallel to one another.

Connectors are at each end of the transverse support frames for attaching to the laterally adjustable frame for providing lateral adjustment. In the preferred embodiment, the connectors are enclosed connectors, such as clamshell connectors.

In the preferred embodiment, the front brace and the apex of the V-brace is attached to the brace of the console. In addition, the frame may include a plurality of stand offs for attaching the first and second stands to the sides of the console.

The first and second stands may also include handgrips. In the preferred embodiment, the handgrips are attached to the trailing edge of each of the stands.

In the preferred embodiment, the vehicle and frame further includes a canopy assembly attached to the laterally adjustable frame. The canopy assembly includes a peripheral frame for attachment to the laterally adjustable frame and a cover connected to the peripheral frame. Preferably, the peripheral frame is continuous. In addition, the peripheral frame may be generally oval or rectangular.

The cover may be a fabric cover. Preferably, the cover is attached by eyelets and lashings to the peripheral frame. The frame may further include a plurality of support ribs for supporting the cover.

In the preferred embodiment, the vehicle is a marine vessel and includes a motor and propeller. Although the laterally adjustable frame could be attached to some sailboats having a console.

For such a marine vessel, the console includes a first side, a second side, and a brace for connecting the first and second sides. The first side may further include an access door. In addition, the console may further include an upper backside, which may include an instrument panel. Similarly, the console may further include a lower backside, which may include a footrest. Finally, the console may include a top side and a front side, although many marine vessel consoles do not. For consoles having a front side, the front side may be removable for access to the console controls for maintenance and repair.

Accordingly, one aspect of the present invention is to provide a vehicle having a canopy, the apparatus including: a vehicle; a console; and a laterally adjustable frame attached to the console.

Another aspect of the present invention is to provide a laterally adjustable frame for supporting a canopy assembly for a vehicle having a console, the frame including: a first stand; a second stand; a plurality of lateral support frames; at least one pair of transverse support frames, each of the frames having a connector connecting along the length of each of the lateral support frames; and a front brace for attaching to the first and second stands.

Still another aspect of the present invention is to provide a vehicle having a canopy, the apparatus including: a vehicle; a console; a laterally adjustable frame attached to the console, the frame including: (i) a first stand; (ii) a second stand; (iii) a plurality of lateral support frames; (iv) at least one pair of transverse support frames, each of the frames having a connector connecting along the length of each of the lateral support frames; and (v) a front brace for attaching to the first and second stands; and a canopy assembly attached to the laterally adjustable frame.

These and other aspects of the present invention will become apparent to those skilled in the art after a reading of the following description of the preferred embodiment when considered with the drawings.

DESCRIPTION OF THE PREFERRED EMBODIMENTS

Figure 1:
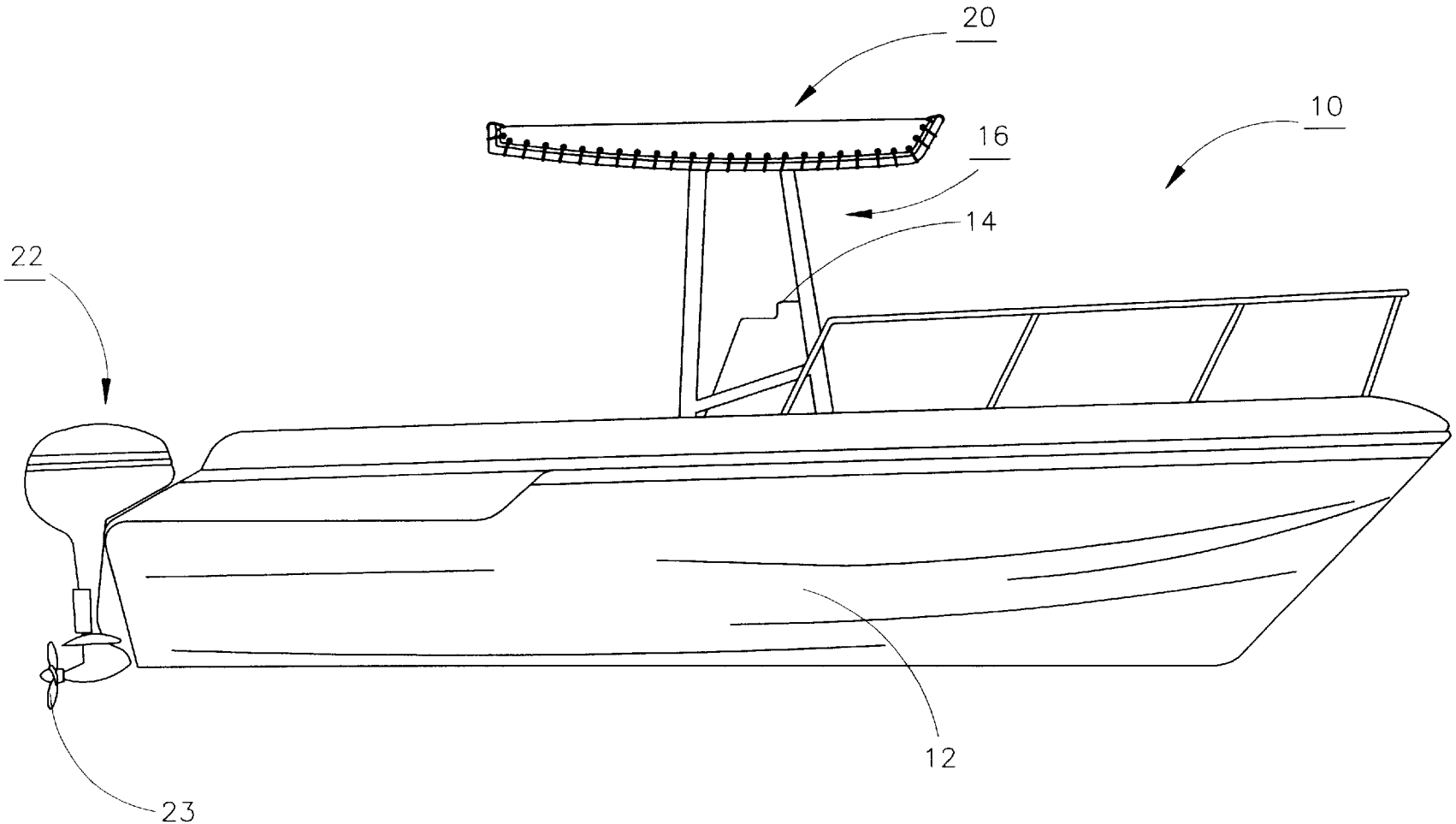
FIG. 1 shows a side view of a vehicle having a canopy, constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto.

FIG. 1 shows a vehicle having a canopy, generally designated 10, constructed according to the present invention. The present invention includes a vehicle 12, a console 14, a canopy assembly 20, and a laterally adjustable frame for supporting the canopy assembly 16. The vehicle 12 may be a marine vessel and further includes a motor 22 and a propeller 23 driven by the motor 22.

Figure 2:
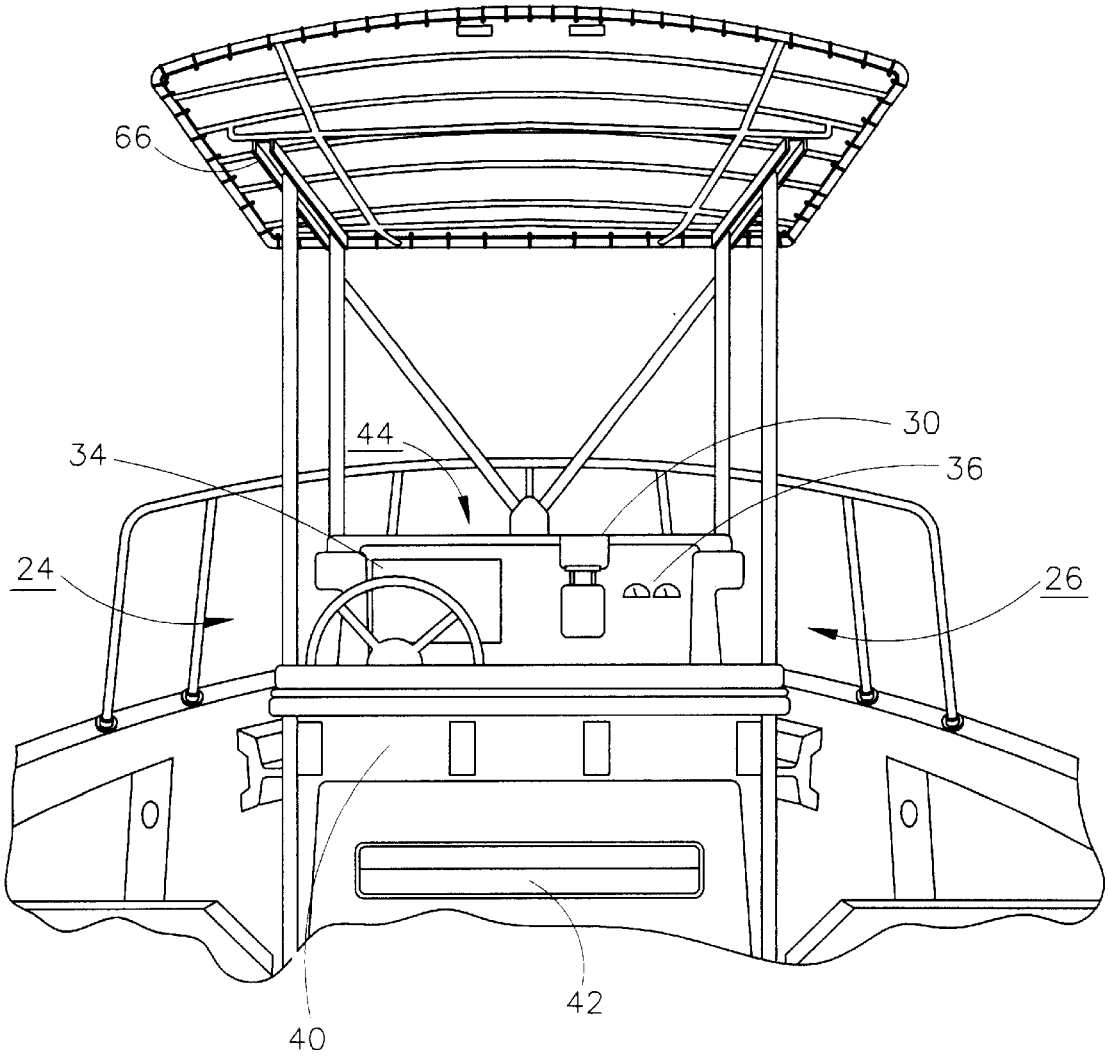
FIG. 2 is a rear view of the canopy attached to the console of the vehicle.
Figure 3:
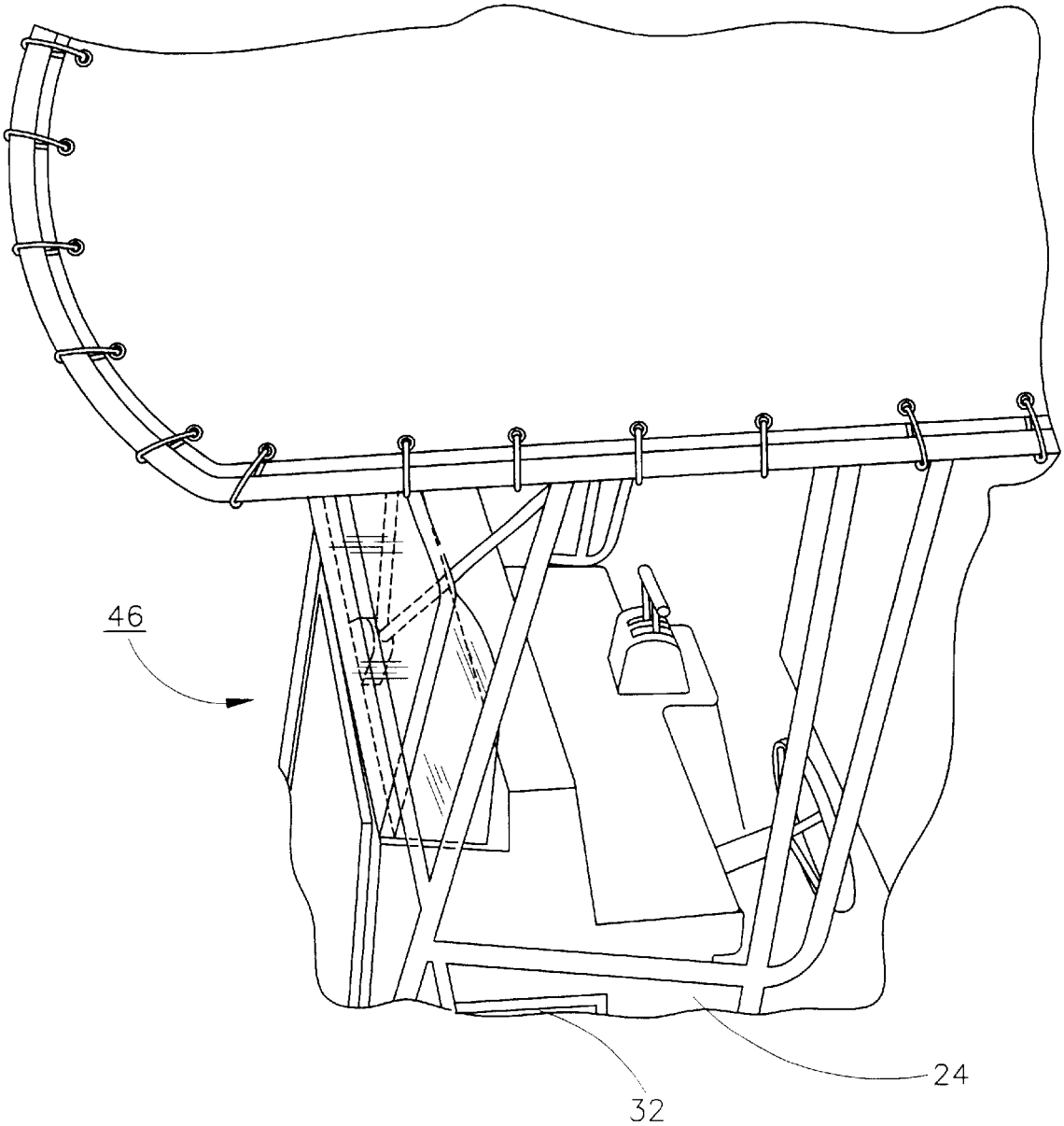
FIG. 3 is a left front perspective view of the canopy attached to the console of the vehicle.

As best shown in FIGS. 2 and 3, the console 14 has a first side 24, a second side 26, and a brace 30 for connecting the first and second sides. The first side 24 further includes an access door 32. The console 14 further includes an upper backside 34 that further includes an instrument panel 36. The console 14 may also include a lower backside 40 that further includes a footrest 42. As best seen in FIG. 3, in the preferred embodiment, the console 14 further includes a front side 46, which is removable for access.

Figure 4:
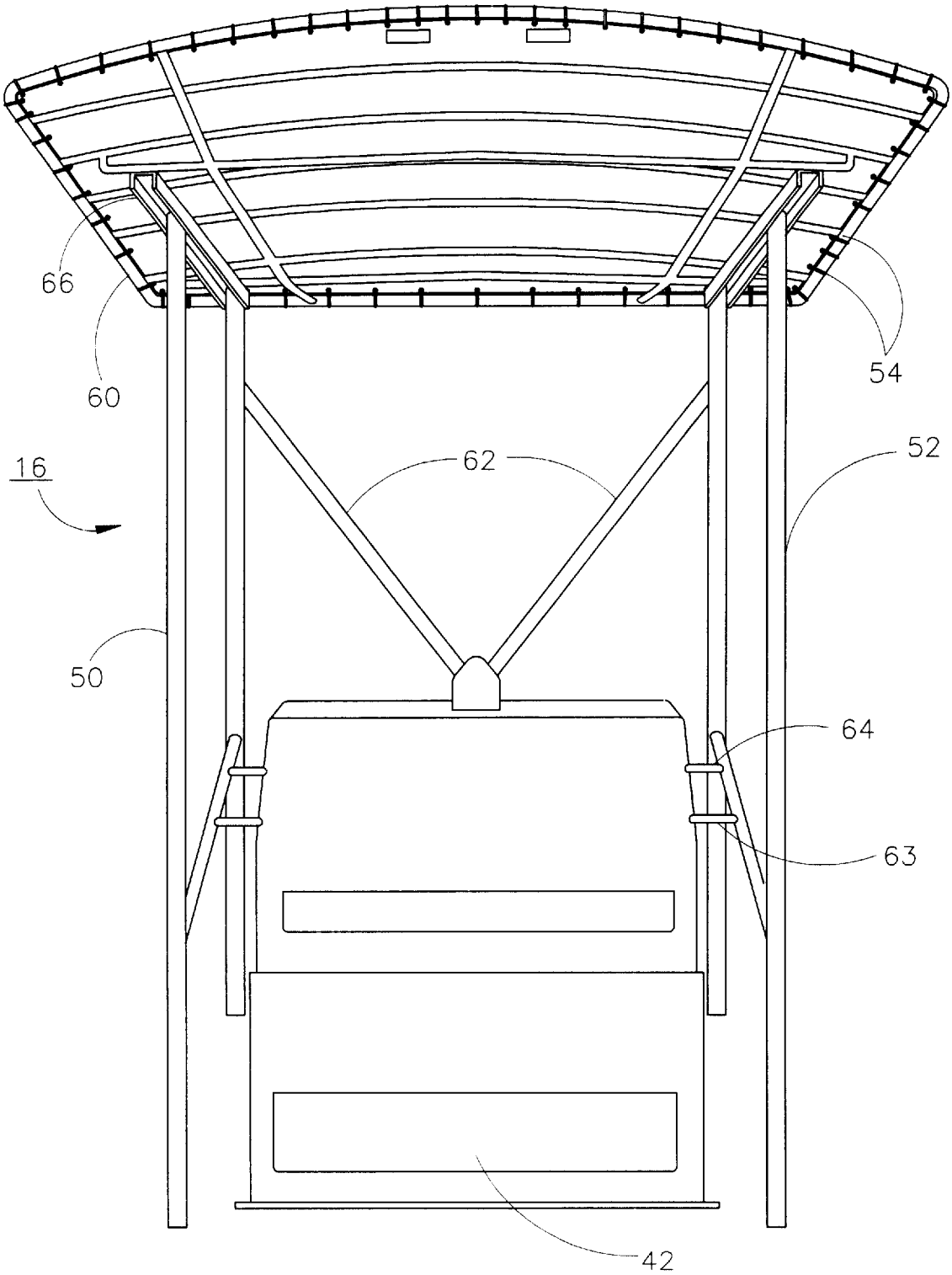
FIG. 4 is a rear view of the canopy attached to the console of the vehicle.
Figure 5:
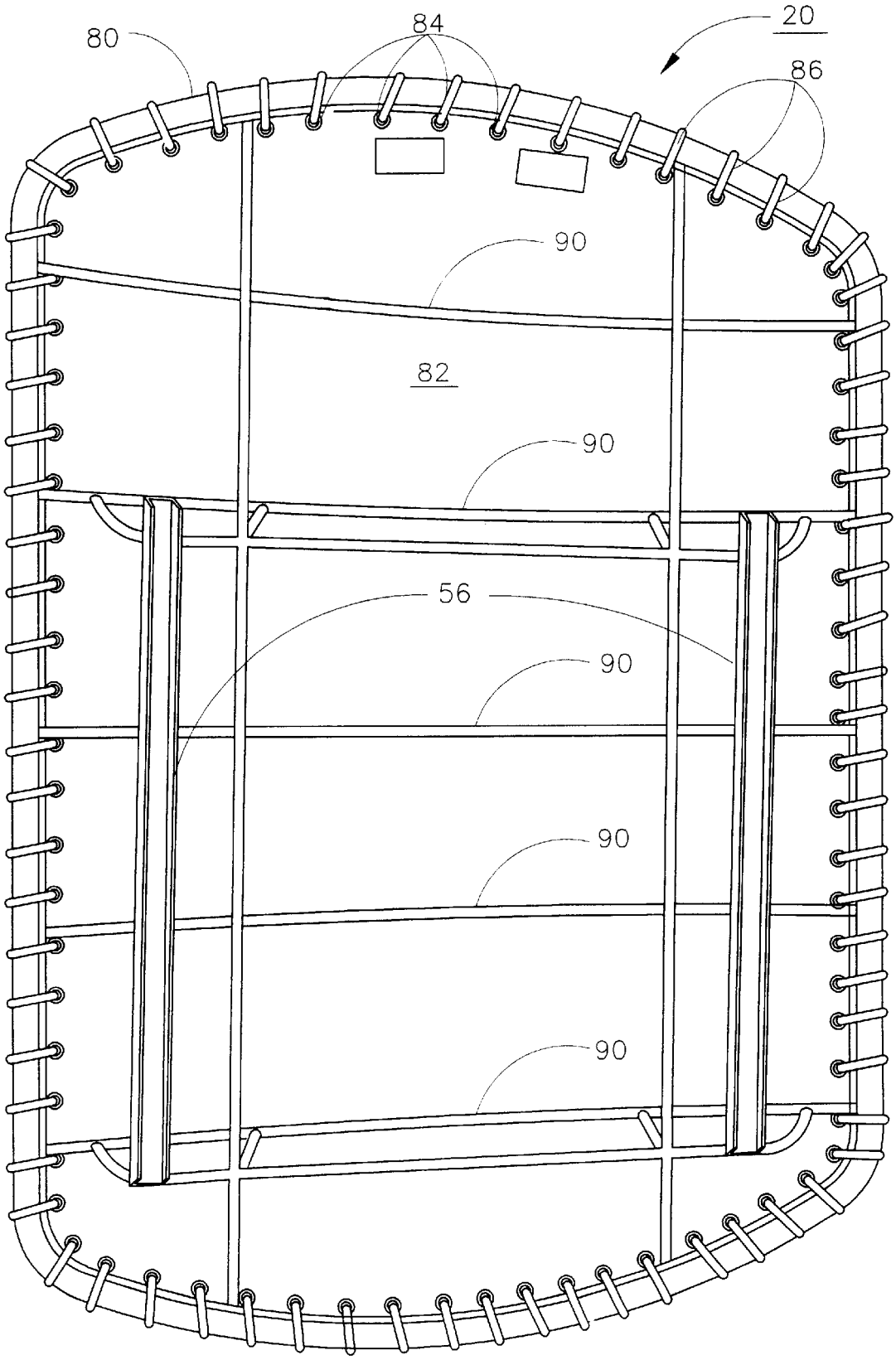
FIG. 5 is a bottom view of the canopy assembly.

As best seen in FIGS. 4 and 5, the laterally adjustable frame 16 includes a first stand 50, a second stand 52, a plurality of lateral support frames 54, and a pair of transfer support frames 56. Each of the transfer support frames 56 has a connector 60 for connecting along the length of each of the lateral support frames 54, and a front brace 62 for attaching to the front side of the console.

In the preferred embodiment, the laterally adjustable frames 16 further include a plurality of stand offs 64 and handgrips 63 for connecting to the console sides for further support. The laterally adjusting frames 16 further include a fastener 66 wherein the fastener is a knurled cup point socket set screw.

The canopy assembly 20 includes a peripheral frame 80 and a cover 82 attached to peripheral frame 80. In the preferred embodiment, the cover 82 is fabric and has eyelets 84 and lashings 86 for connecting the cover 82 to the frame 80.

To install the present invention on an existing vehicle, such as a marine vessel having a console, the first stand 50 and the second stand 52 are attached to the deck of the vessel by conventional fasteners, on each side of the console. The front brace 62 is then attached to the front side of the console. In the preferred embodiment, a plurality of stand offs 64 are connected to the console sides for further support. Next, the canopy assembly 20, which includes peripheral frame 80 and a cover 82 attached to peripheral frame 80, is secured to the first and second stands. In the preferred embodiment, the laterally adjusting frames 16 are secured in place by a fastener 66 wherein the fastener is a knurled cup point socket set screw. Knurled cup point socket set screws are an improvement on the cup point as it has serrations on its tip and its flat end which provides a more secure connection for high stress conditions, such as boating.

Certain modifications and improvements will occur to those skilled in the art upon a reading of the foregoing description. By way of example, to provide a greater range of adjustability of incline, the weld on the feet at three inches may be replaced by adjustable angle feet. Also, to provide fit to future boats dimensions may be altered. It should be understood that all such modifications and improvements have been deleted herein for the sake of conciseness and readability but are properly within the scope of the following claims.

We claim:

1. A vehicle having a canopy, said apparatus comprising:

(a) a vehicle;

(b) a console; and (c) a laterally adjustable frame attached to said console, wherein said laterally adjustable frame includes: (i) a plurality of lateral support frames; and (ii) at least one pair of transverse support frames, each of said frames having a connector connecting along the length of each of said lateral support frames.

2. The apparatus according to claim 1, further including a canopy assembly attached to said laterally adjustable frame.

3. The apparatus according to claim 2, wherein said canopy assembly includes a peripheral frame for attachment to said laterally adjustable frame and a cover connected to said peripheral frame.

4. The apparatus according to claim 3, wherein said peripheral frame is continuous.

5. The apparatus according to claim 3, wherein said peripheral frame is oval.

6. The apparatus according to claim 3, wherein said peripheral frame is rectangular.

7. The apparatus according to claim 3, wherein said cover is a fabric cover.

8. The apparatus according to claim 7, wherein said cover is attached by eyelets and lashings to said peripheral frame.

9. The apparatus according to claim 3, further including a plurality of support ribs.

10. The apparatus according to claim 1, wherein said vehicle is a marine vessel.

11. The apparatus according to claim 1, wherein said vehicle further includes a motor.

12. The apparatus according to claim 11, wherein said motor is a propeller driven motor.

13. The apparatus according to claim 1, wherein said console includes a first side, a second side, and a brace for connecting said first and second sides.

14. The apparatus according to claim 13, wherein said first side further includes an access door.

15. The apparatus according to claim 13, wherein said console further includes an upper backside.

16. The apparatus according to claim 15, wherein said upper backside includes an instrument panel.

17. The apparatus according to claim 13, wherein said console further includes a lower backside.

18. The apparatus according to claim 17, wherein said lower backside further includes a footrest.

19. The apparatus according to claim 13, wherein said console further includes a top side.

20. The apparatus according to claim 13, wherein said console further includes a front side.

21. The apparatus according to claim 20, wherein said front side is removable for access.

22. A laterally adjustable frame for supporting a canopy assembly for a vehicle having a console, said frame comprising:

(a) a first stand;

(b) a second stand;

(c) a plurality of lateral support frames;

(d) at least one pair of transverse support frames, each of said frames having a connector connecting along the length of each of said lateral support frames; and (e) a front brace for attaching to said first and second stands, wherein said front brace includes at least one V-shaped portion and wherein the apex of said V-shaped portion of said front brace is attached to said console.

23. The apparatus according to claim 22, wherein said first and second stands are inclined about 3 degrees towards the centerline of said vehicle.

24. The apparatus according to claim 22, wherein said lateral support frames are offset.

25. The apparatus according to claim 22, wherein said lateral support frames are laterally continuous.

26. The apparatus according to claim 22, wherein said lateral support frames are C-frames.

27. The apparatus according to claim 22, wherein said lateral support frames are ladder frames.

28. The apparatus according to claim 22, wherein said transverse support frames are substantially parallel to one another.

29. The apparatus according to claim 22, wherein said connectors are at each end of said transverse support frames.

30. The apparatus according to claim 22, wherein said connectors are enclosed connectors.

31. The apparatus according to claim 22, wherein said connectors are clamshell connectors.

32. The apparatus according to claim 22, further including a plurality of stand offs for attaching said first and second stands to the sides of said console.

33. The apparatus according to claim 22, wherein said first and second stands include a hand grip.

34. The apparatus according to claim 22, further including a fastener for attaching said connector to said lateral support frame.

35. The apparatus according to claim 34, wherein said connector is a knurled cup point socket set screw.

36. A vehicle having a canopy, said apparatus comprising:

(a) a vehicle;

(b) a console;

(c) a laterally adjustable frame attached to said console, said frame including: (i) a first stand; (ii) a second stand; (iii) a plurality of lateral support frames; (iv) at least one pair of transverse support frames, each of said frames having a connector connecting along the length of each of said lateral support frames; and (v) a front brace for attaching to said first and second stands; and (d) a canopy assembly attached to said laterally adjustable frame.

37. The apparatus according to claim 36, wherein said canopy assembly includes a peripheral frame for attachment to said laterally adjustable frame and a cover connected to said peripheral frame.

38. The apparatus according to claim 37, wherein said peripheral frame is continuous.

39. The apparatus according to claim 37, wherein said peripheral frame is oval.

40. The apparatus according to claim 37, wherein said peripheral frame is rectangular.

41. The apparatus according to claim 37, wherein said cover is a fabric cover.

42. The apparatus according to claim 41, wherein said cover is attached by eyelets and lashings to said peripheral frame.

43. The apparatus according to claim 37, further including a plurality of support ribs.

44. The apparatus according to claim 36, wherein said vehicle is a marine vessel.

45. The apparatus according to claim 36, wherein said vehicle further includes a motor.

46. The apparatus according to claim 45, wherein said motor is a propeller driven motor.

47. The apparatus according to claim 36, wherein said console includes a first side, a second side, and a brace for connecting said first and second sides.

48. The apparatus according to claim 47, wherein said first side further includes an access door.

49. The apparatus according to claim 47, wherein said console further includes an upper backside.

50. The apparatus according to claim 49, wherein said upper backside includes an instrument panel.

51. The apparatus according to claim 47, wherein said console further includes a lower backside.

52. The apparatus according to claim 51, wherein said lower backside further includes a footrest.

53. The apparatus according to claim 47, wherein said console further includes a top side.

54. The apparatus according to claim 47, wherein said console further includes a front side.

55. The apparatus according to claim 54, wherein said front side is removable for access.

56. The apparatus according to claim 36, wherein said first and second stands are inclined about 3 degrees towards the centerline of said vehicle.

57. The apparatus according to claim 36, wherein said lateral support frames are offset.

58. The apparatus according to claim 36, wherein said lateral support frames are laterally continuous.

59. The apparatus according to claim 36, wherein said lateral support frames are C-frames.

60. The apparatus according to claim 36, wherein said lateral support frames are ladder frames.

61. The apparatus according to claim 36, wherein said transverse support frames are substantially parallel to one another.

62. The apparatus according to claim 36, wherein said connectors are at each end of said transverse support frames.

63. The apparatus according to claim 36, wherein said connectors are enclosed connectors.

64. The apparatus according to claim 36, wherein said connectors are clamshell connectors.

65. The apparatus according to claim 36, wherein said front brace and the apex of said V-brace is attached to the brace of said console.

66. The apparatus according to claim 36, further including a plurality of stand offs for attaching said first and second stands to the sides of said console.

67. The apparatus according to claim 36, wherein said first and second stands include a hand grip.

68. The apparatus according to claim 36, further including a fastener for attaching said connector to said lateral support frame.

69. The apparatus according to claim 68, wherein said connector is a knurled cup point socket set screw.

* * * * *